US011891241B2

(12) United States Patent
Saeterdal et al.

(10) Patent No.: US 11,891,241 B2
(45) Date of Patent: Feb. 6, 2024

(54) SUBSEA FLUID STORAGE UNIT

(71) Applicant: Subsea 7 Norway AS, Stavanger (NO)

(72) Inventors: Morten Saeterdal, Klepp St. (NO); Sigbjorn Daasvatn, Hornnes (NO)

(73) Assignee: SUBSEA 7 NORWAY AS, Stavanger (NO)

( * ) Notice: Subject to any disclaimer, the term of this patent is extended or adjusted under 35 U.S.C. 154(b) by 176 days.

(21) Appl. No.: 17/259,039

(22) PCT Filed: Jul. 8, 2019

(86) PCT No.: PCT/EP2019/068294

§ 371 (c)(1),
(2) Date: Jan. 8, 2021

(87) PCT Pub. No.: WO2020/011727

PCT Pub. Date: Jan. 16, 2020

(65) Prior Publication Data

US 2021/0269234 A1 Sep. 2, 2021

(30) Foreign Application Priority Data

Jul. 9, 2018 (GB) ..... 1811237

(51) Int. Cl.
*B65D 88/78* (2006.01)
*B63B 25/16* (2006.01)
(Continued)

(52) U.S. Cl.
CPC ..... *B65D 88/78* (2013.01); *B63B 25/16* (2013.01); *B63G 8/42* (2013.01); *B65D 88/005* (2013.01);
(Continued)

(58) Field of Classification Search
CPC .... B65D 88/78; B65D 88/005; B65D 88/744; B65D 90/046; B32B 25/16; E21B 43/01
(Continued)

(56) References Cited

U.S. PATENT DOCUMENTS 2,924,350 A * 2/1960 Greer ..... B65D 88/78 405/53
3,824,942 A 7/1974 Stafford et al.
(Continued)

FOREIGN PATENT DOCUMENTS

CN 105151580 12/2015
DE 60304594 1/2007
(Continued)

*Primary Examiner* — Anthony D Stashick
*Assistant Examiner* — Raven Collins
(74) *Attorney, Agent, or Firm* — MATTINGLY & MALUR, PC

(57) ABSTRACT

A modular subsea fluid storage unit has a variable-volume inner tank having a rigid top panel and a peripheral wall that is flexible by virtue of concertina formations. The peripheral wall is extensible and retractable vertically while the horizontal width of the tank remains substantially unchanged. A side wall of a lower housing part surrounds and is spaced horizontally from the peripheral wall of the inner tank to define a floodable gap between the peripheral wall and the side wall that surrounds the tank. An upper housing part extends over and is vertically spaced from the top panel of the inner tank and overlaps the side wall to enclose the inner tank. The floodable gap and the upper housing part enhance thermal insulation and trap any fluids that may leak from the inner tank.

28 Claims, 10 Drawing Sheets

(51) Int. Cl.

| | |
|---|---|
| ***B65D 88/00*** | (2006.01) |
| ***B65D 88/74*** | (2006.01) |
| ***B65D 90/04*** | (2006.01) |
| ***E21B 43/01*** | (2006.01) |
| ***B63G 8/42*** | (2006.01) |
| ***B65D 88/18*** | (2006.01) |
| ***B65D 90/24*** | (2006.01) |
| *E21B 43/017* | (2006.01) |

(52) U.S. Cl.
CPC ..... *B65D 88/18* (2013.01); *B65D 88/744* (2013.01); *B65D 90/24* (2013.01); *B63G 2008/425* (2013.01); *B65D 90/046* (2013.01); *E21B 43/017* (2013.01); *E21B 43/0122* (2013.01)

(58) Field of Classification Search
USPC ..... 220/565
See application file for complete search history.

(56) References Cited

U.S. PATENT DOCUMENTS

| | | | | |
|---|---|---|---|---|
| 4,365,576 | A | 12/1982 | Cook | |
| 4,402,632 | A * | 9/1983 | Cook | F17C 3/005 114/257 |
| 5,673,664 | A * | 10/1997 | Lassanske | F01M 11/0004 123/196 R |
| 7,448,404 | B2 | 11/2008 | Samuelsen et al. | |
| 9,470,365 | B1 | 10/2016 | Atkinson et al. | |
| 9,540,169 | B1 | 1/2017 | Krohn | |
| 2002/0009330 | A1 | 1/2002 | Northcott et al. | |
| 2008/0302115 | A1 | 12/2008 | Eknes et al. | |
| 2013/0167962 | A1 | 7/2013 | Skjetne et al. | |
| 2014/0133922 | A1 | 5/2014 | Hantz | |
| 2016/0023843 | A1 * | 1/2016 | Donahue | B65D 88/78 114/257 |
| 2016/0319652 | A1 | 11/2016 | Kalli et al. | |
| 2018/0072494 | A1 * | 3/2018 | Primm | B65D 88/62 |
| 2018/0148137 | A1 | 5/2018 | Castello et al. | |

FOREIGN PATENT DOCUMENTS

| | | | | |
|---|---|---|---|---|
| EP | 1 554 197 | | 5/2004 | |
| EP | 2169690 | * | 9/2008 | H01F 27/14 |
| EP | 2 169 690 | | 3/2010 | |
| EP | 2 610 881 | | 7/2013 | |
| FR | 2776274 | | 9/1999 | |
| GB | 2499804 | | 9/2013 | |
| JP | S53144020 | | 12/1978 | |
| JP | S5648987 | | 5/1981 | |
| JP | S581681 | | 1/1983 | |
| JP | S5962480 | | 4/1984 | |
| JP | S59103884 | | 6/1984 | |
| JP | 2009274946 | | 11/2009 | |
| KR | 20140014891 | | 2/2014 | |
| KR | 20170024958 | | 3/2017 | |
| KR | 20170028648 | | 3/2017 | |
| KR | 20170099193 | | 8/2017 | |
| WO | WO 95/23749 | | 9/1995 | |
| WO | WO 2012/087149 | | 6/2012 | |
| WO | WO 2015110413 | | 7/2015 | |
| WO | WO 2016/116625 | | 7/2016 | |
| WO | WO 2016179371 | | 11/2016 | |

* cited by examiner

SUBSEA FLUID STORAGE UNIT

This invention relates to the storage of fluids such as crude oil or natural gas subsea, and particularly to the challenges of retaining heat in fluids stored underwater, maintaining a subsea storage facility and containing any leakage of stored fluids.

The background to the invention is the challenge of developing marginal subsea oil fields, including small, remote or inaccessible fields. To address that challenge, it is necessary to minimise the cost of production and related capital investment and to simplify the installation and operation of the necessary subsea infrastructure.

Offshore exploration for oil and gas is being performed in ever more challenging waters, with fields now being developed in water depths of 3000 metres or even more. To recover hydrocarbons from such depths, the designers of riser and offloading systems face various technical challenges. Metocean characteristics and relatively low reservoir temperatures compound those challenges.

A typical subsea oil production system comprises production wells each with a wellhead; pipelines running on the seabed; subsea structures to support valves and connectors; subsea manifolds; and risers to bring production fluids to the surface. At the surface, a topside installation, which can be a platform or a vessel, receives the production fluids before their onward transportation.

Crude oil is a multiphase fluid. Specifically, a wellstream generally contains a mixture of sand, oil, water and gas. Also, the wellstream is hot at the outlet of the wellhead, typically around 200° C. If its temperature decreases below a certain threshold, at a given pressure, components of the wellstream may react together or individually to gel, coalesce, coagulate or precipitate as solid waxes, asphaltenes or hydrates. For example, wax will typically appear in oil at a temperature of around 30° C. An accumulation of such solids could eventually plug a pipeline.

A blockage in a subsea pipeline is extremely disruptive and expensive to rectify. It is therefore a common objective to maintain the oil temperature above the critical threshold until the oil has been delivered to a topside installation. There, the oil can be treated to allow the treated oil to be transported at ambient temperature in tankers or in pipelines.

To reduce the cost of producing oil from marginal subsea fields, one approach is to simplify subsea equipment as much as possible, for example by using a long pipeline extending from a wellhead and minimal additional equipment subsea. A challenge of that approach is that pipeline cost becomes a large element of the cost of development where fields are isolated or remote.

In this respect, conventional solutions to maintain oil temperature employ 'wet' thermal insulation, which involves covering the pipeline with thermally-insulating materials. The pipeline may also be heated by electrical heating or by heat transfer from hot fluids. However, as some pipelines may be very long, in some cases longer than 100 km, such solutions can become inordinately expensive.

Another approach adopts an opposite tactic, namely to transfer at least some conventionally-topside production and storage functions to a subsea location for intermittent export of oil by tanker vessels. By displacing at least some oil processing steps from topside to the seabed, there is less need for thermal insulation or heating of subsea pipelines. The present invention arises from this second approach, which involves subsea storage of produced oil.

Subsea storage units for hydrocarbons face various technical challenges. A key challenge is to handle pressure differentials between external hydrostatic pressure and variable internal pressure. Such units must also provide for a variable internal volume as they are filled with, and emptied of, hydrocarbons. They must also deal with a substantial temperature difference between their contents and the surrounding seawater, which is uniformly at about 4° C. at depths in excess of 1000 m.

In deep water, the need to withstand hydrostatic pressure makes rigid subsea storage tanks impractical. For example, in a water depth of around 2000 m, the hydrostatic pressure will be about 200 bars. This would necessitate an impractically large and heavy tank that would also be difficult to install. Thus, many proposed subsea units for storing hydrocarbons employ an internal expandable bag or bladder.

The use of a bladder or a deformable membrane addresses the problem of differential pressure so that internal and external pressures are balanced. However, such a bladder or membrane requires fine pressure management to avoid bursting.

EP 1554197 and WO 2016/116625 disclose typical subsea storage tanks in which a storage bag is located within a rigid support frame. Such a storage system requires additional pumps for managing differential pressure. US 2016/319652 and WO disclose other designs of subsea storage tank with a flexible bladder or bag within a protective rigid structure.

U.S. Pat. No. 9,540,169 discloses a subsea storage tank containing a bladder that comprises tandem or sandwich fluid barriers. In U.S. Pat. No. 9,470,365, storage is provided by inner and outer bags that are enclosed within a casing with a removable cover.

WO 2016/179371 discloses a subsea storage container that has an internal flexible storage volume. The problem of pressure compensation is addressed by balancing the inner and external pressure through a piping and valve arrangement that also provides a ballasting system for installation. However, this solution is heavy and would be difficult to recover and to maintain or to repair in case of leakage. Also, no provisions are made for thermal insulation of the storage volume or of the surrounding container.

JP S59103884, KR 20170024958, U.S. Pat. No. 2,924,350, WO 2015/110413, WO 2012/087149, US 2014/133922, CN 105151580, US 2018/148137 and U.S. Pat. No. 4,402,632 all describe various subsea storage units having variable volume storage tanks.

JP S581681 describes another underwater storage system for storing oil in tanks at a subsea location. KR 20170099193 describes storing monoethylene glycol (MEG) in an expandable underwater tank.

KR 20170028648 describes an underwater tank surrounded by an outer casing. In KR 20170028648 the underwater tank is heated by a heating pipe that is wrapped around the tank.

US 2013/167962 and EP 2169690 describe pressure compensators for use at a subsea location. US 2008/302115 describes a container for housing electrical equipment such as underwater sensors. The electrical equipment is cooled by a cooling fluid and the cooling fluid is stored within a variable-volume bellows that acts as a pressure compensator.

JP S5648987, JP S53144020, JP S5962480 and U.S. Pat. No. 3,824,942 describe various double-walled storage tanks that may be suspended at a subsea location.

FR 2776274 replaces a bladder with a mobile plate that can travel up and down inside a rigid storage tank like a piston. No pressure compensation is needed because the stored fluid is substantially at hydrostatic pressure, thanks to a volume of seawater in the lower part of the storage tank.

The plate isolates this volume of seawater from the storage space. Seals allow the plate to close the transverse section of the tank, although it is a challenge to ensure tight sealing of the storage volume in a way that allows the plate to move.

A key drawback of the system disclosed in FR 2776274 is that the storage volume is only separated from cold seawater by a wall. The wall therefore requires thick layers of thermal insulation to isolate the stored fluid from cold seawater in case hydrates, asphaltenes or waxes could form when the stored fluid is crude oil or natural gas. Additionally, there is a risk that any leakage of the stored fluid will escape into the marine environment.

US 2002/009330 describes a method of constructing an underground storage tank. Similarly, U.S. Pat. No. 9,470,365, GB 2499804, JP 2009274946, U.S. Pat. Nos. 4,365,576, 4,402,632 and WO 2016/179371 describe various methods of lowering storage tanks to the seabed.

Against this background, the invention provides a subsea fluid storage unit that comprises: a variable-volume inner tank having a rigid top panel and a peripheral wall that is extensible and retractable in a vertical direction; a side wall that surrounds and is spaced from the peripheral wall of the inner tank in a horizontal direction to define a floodable gap that surrounds the tank between the peripheral wall and the side wall; and an upper housing part that extends over and is spaced from the top panel of the inner tank in the vertical direction and cooperates with the side wall to enclose the inner tank. Elegantly, the rigid top panel may be sandwiched between the upper housing part and the side wall.

The upper housing part suitably overlaps the inner tank in the horizontal direction, and is preferably substantially continuous across a full width of the inner tank in the horizontal direction. The upper housing part may also overlap the side wall in the horizontal direction. In that case, a skirt of the upper housing part may extend substantially parallel to the side wall on an external side of the side wall. The skirt suitably adjoins or abuts a ledge that projects outwardly from the side wall.

To trap any fluid leaking from the inner tank, the upper housing part may rise inwardly from the side wall to an elevated fluid trap chamber. The storage unit may further comprise a leakage sensor arranged to sense leaked fluid in the fluid trap chamber and a drainage pipe that communicates with the fluid trap chamber to drain the leaked fluid.

The invention also provides a subsea fluid storage unit that comprises: a variable-volume inner tank having a rigid top panel and a peripheral wall that is extensible and retractable in a vertical direction to vary a height dimension of the tank while the tank remains of substantially unchanged width in a horizontal direction; and a side wall surrounding and spaced from the peripheral wall of the inner tank in the horizontal direction to define a floodable gap that surrounds the tank between the peripheral wall and the side wall, which gap has a closed top.

The side wall is preferably thermally insulated. More generally, the side wall preferably has lower thermal transmittance than the peripheral wall of the inner tank.

The inner tank may be closed by a bottom plate that extends in the horizontal direction along a bottom edge of the peripheral wall. The bottom plate suitably projects beyond the peripheral wall in the horizontal direction. This may leave a clearance, preferably a sliding clearance, between the bottom plate and the side wall that is narrower horizontally than the floodable gap. Conveniently, the bottom plate can support a heating system for heating fluid contents of the tank in use.

The peripheral wall is preferably flexible but suitably has greater stiffness in the horizontal direction than in the vertical direction. For example, the peripheral wall may comprise folded or hinged formations that are expandable in the manner of a concertina.

The side wall may be contiguous with a base to define a floodable enclosure that extends beneath the inner tank, which enclosure suitably communicates with the floodable gap. The base may be thermally insulated. A seawater inlet/outlet may communicate between the enclosure and an ambient body of seawater in which the storage tank is submerged.

Conveniently, the inner tank may close an open top of the enclosure. For example, the rigid top panel of the inner tank may be supported by the side wall. For this purpose, the side wall suitably supports a hanging flange of the top panel that projects beyond the peripheral wall in the horizontal direction.

The storage unit may comprise a leakage sensor that is arranged to sense any fluid in the floodable gap leaked from the inner tank. A drainage line suitably communicates with the floodable gap to drain the leaked fluid.

The rigid top panel of the inner tank may rise inwardly from the side wall to an elevated gas trap chamber for trapping gas rising from a fluid in the inner tank.

Subsea-releasable fastenings may act between the inner tank and the side wall, for example in tension.

At least a portion of the side wall may be substantially flat. This facilitates grouping two or more units side-by-side. In this respect, the inventive concept embraces a group of units of the invention, coupled together for fluid communication between the inner tanks of the group. The units of such a group may, for example, be arranged in an elongate towable array.

The inventive concept extends to a method of storing a fluid underwater, which fluid is warmer than ambient water. The method comprises: holding the fluid in a tank that has a peripheral wall; conducting heat from the fluid through the peripheral wall to heat water in a gap defined between the peripheral wall and a side wall outside the peripheral wall; and holding the heated water in the gap. The volume of the tank may be varied by extending or retracting the peripheral wall while holding the heated water in the gap.

Heat transfer through the side wall is preferably resisted by means of at least one thermally insulating layer that is incorporated in or attached to the side wall.

The heated water may be held in the gap by confining the heated water above a body of cooler water. For example, the body of cooler water may itself be confined in an enclosure that extends under the tank. In other approaches, the heated water may be held in the gap by confining the heated water above a plate that extends from the peripheral wall toward the side wall and/or by confining the heated water under a closed top that extends from the peripheral wall to the side wall.

The invention also provides a method of assembling a subsea fluid storage unit. The method comprises: lowering a lower housing part to a subsea location; lowering an inner tank to the subsea location; placing the inner tank into the lower housing part; lowering an upper housing part to the subsea location; and bringing together the upper housing part and the lower housing part to form a housing that surrounds the inner tank.

The lower housing part is suitably overlapped with the upper housing part. The upper housing part may, for example, be lowered telescopically onto the lower housing part.

An open top of the lower housing part may be closed by the inner tank. The inner tank may be sandwiched between the upper housing part and the lower housing part. Buoyant upthrust forces are conveniently transferred from the inner tank to a subsea foundation via the lower housing part.

The inner tank may expand into the lower housing part when the inner tank is being filled with a fluid. A fluid leaking from the inner tank may be trapped in the upper housing part and/or in a gap between the expanded inner tank and the lower housing part.

The inventive concept may also be expressed as a method of maintaining or repairing a subsea fluid storage unit. The method comprises: removing an upper housing part from a lower housing part to disassemble a housing that surrounds an inner tank; removing the inner tank from the lower housing part; replacing the inner tank, or placing another inner tank, into the lower housing part; and replacing the upper housing part onto the lower housing part to reassemble the housing.

Embodiments of the invention provide an underwater storage tank for a fluid, the tank comprising: an expandable storage container; a lower casing element; and an upper casing element, wherein the upper casing element at least partially surrounds the top of the lower casing element and of the expandable storage container.

The fluid may be liquid or gas or a mixture of liquid and gas phases. In particular, the fluid may be a hydrocarbon fluid such as crude oil or natural gas, a hydrocarbon-containing fluid such as produced water, or another fluid such as a chemical that is used for injection into a subsea well or for flow assurance.

The casing elements may be of glass-reinforced plastics (GRP) and/or of sandwich construction.

The upper casing element is suitably wider than the lower casing element. The expandable storage container and the upper casing element may at least partially overlap the lower casing element in a vertical direction.

The expandable storage container may comprise a rigid upper plate and an expandable lower storage volume. For example, the expandable lower storage volume may comprise a concertina or bellows and a lower plate suspended from the upper plate. The upper plate suitably closes the top opening of the lower casing element and may be sealed onto the top opening of the lower casing element.

The lower casing element suitably comprises an inlet and/or outlet for seawater.

A ring of water may laterally surround the expandable lower storage volume inside the lower casing during collapse and/or expansion of the expandable storage container. Advantageously, the ring of water has sufficient thickness to provide thermal insulation. As the bellows expand downwards, seawater is substantially static in the space between the bellows and the walls and so is heated by conduction from the stored fluid, which ensures effective thermal insulation.

Seawater inside the lower casing, for example under the lower plate of the expandable storage container, may be used as ballast to ensure stability of the storage tank on a subsea foundation or on the seabed.

The upper casing element may comprise a rounded triangular-shaped roof and lateral lids. The upper casing element may define an upper containment volume between its roof, its lateral walls, and the rigid upper plate of the expandable storage container. A leak detector is suitably located at an upper point of the upper containment volume.

The upper casing element may comprise a drainage pipe from the topmost point to the sea at the bottom of a lateral lid.

Thus, the structure with the upper cover or casing element provides a double barrier and containment in case of leakage of light fluid from the expandable storage container. This allows having only light sealing between the lower casing element and the bellows roof, namely the rigid upper plate of the expandable storage container. The upper cover also adds weight and stability to the GRP structure.

In summary, the invention proposes a new and safe way of storing crude oil or other fluids subsea. A typical application of the invention is in a small pool field where the distance to the nearest host is too far or existing infrastructure does not have the capacity to handle more crude oil.

The invention provides a subsea storage tank for crude oil or other fluids that defines a double or triple barrier against leakage of the stored fluid into the sea. The tank functions at all depths, being pressure compensated, and isolates seawater and hydrocarbons both thermally and physically, hence reducing the problems of wax and hydrate formation. In this respect, it is possible to integrate electrical heating into one or more constructional elements of the tank. Also, as there is no contact between oil and seawater, no emulsion formation or bacteria growth will ensue at an oil/water interface.

An upper cover part of the storage tank protects against dropped objects and over-trawling. The upper cover part also makes it possible to confine, detect and stop any leak and to empty the tank safely if any emergencies occur.

The storage tank of the invention is based on a modular principle. The modular design also allows a cost-effective production method because all of the main parts may be produced in series by re-using a mould. The modular design also makes it possible to install the storage tank by lifting in three main parts, without the need for a heavy-lift vessel. It is also possible to replace an inner tank at field when necessary, for example in the event of a leak, or at the end of its design life, or when maintenance work is required.

The preferred rectangular shape of the storage tank in plan view provides for better space utilisation and better use of the footprint that is available in an installation frame. For example, it is possible to install multiple tanks together in a towed structure and/or to connect several tanks together into one system.

Thus, preferred embodiments of the invention provide a modular subsea fluid storage unit that comprises a variable-volume inner tank having a rigid top panel and a peripheral wall that is flexible, for example by virtue of concertina formations. The peripheral wall is extensible and retractable vertically while the horizontal width of the tank remains substantially unchanged.

A side wall of a lower housing part surrounds and is spaced horizontally from the peripheral wall of the inner tank to define a floodable gap between the peripheral wall and the side wall that surrounds the tank. An upper housing part extends over and is vertically spaced from the top panel of the inner tank and overlaps the side wall to enclose the inner tank. The floodable gap and the upper housing part enhance thermal insulation and trap any fluids that may leak from the inner tank.

In order that the invention may be more readily understood, reference will now be made, by way of example, to the accompanying drawings in which.

Figure 4:
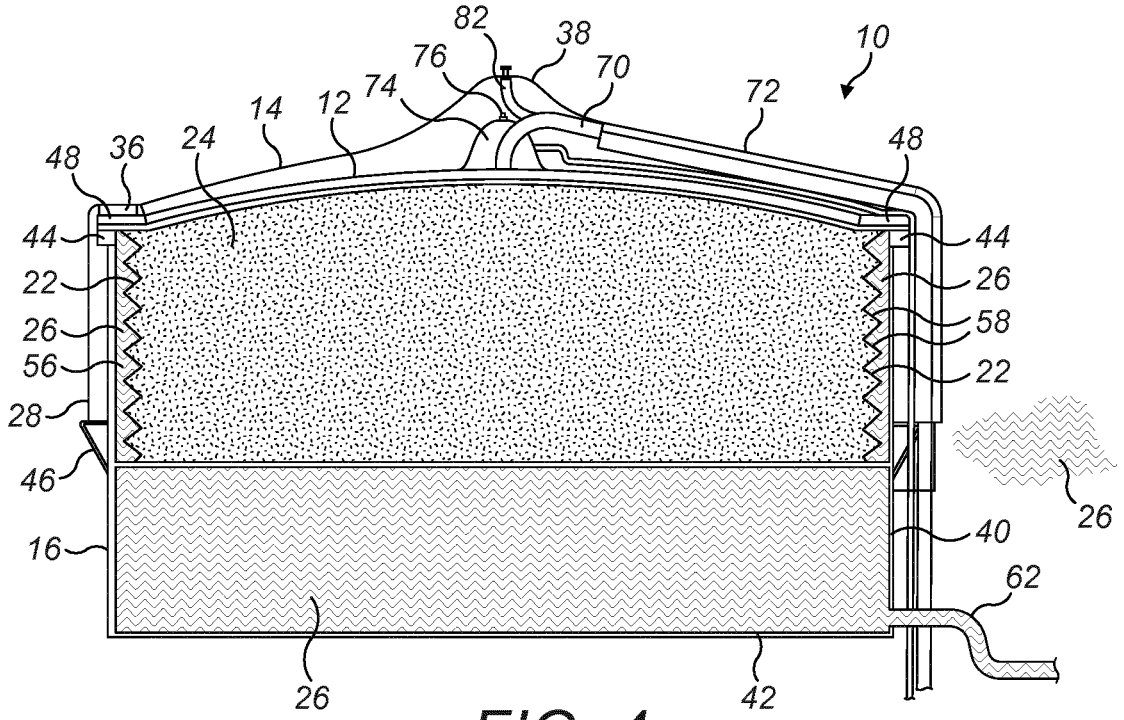
FIG. 4 is a sectional side view of the storage unit shown in FIG. 3, when assembled and part-full of oil.
Figure 6B:
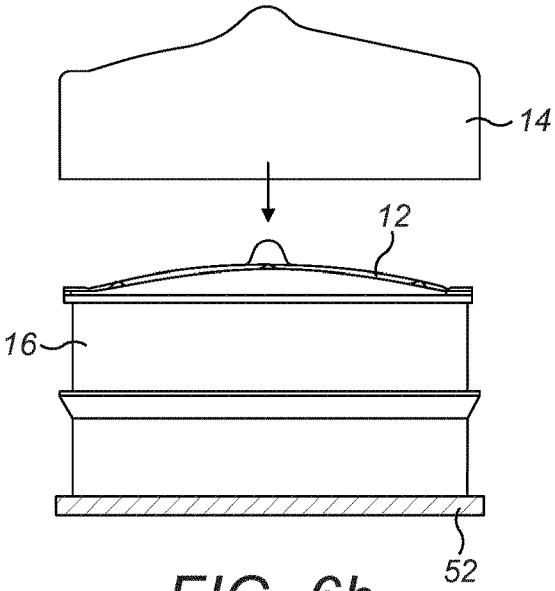
Figure 6A:
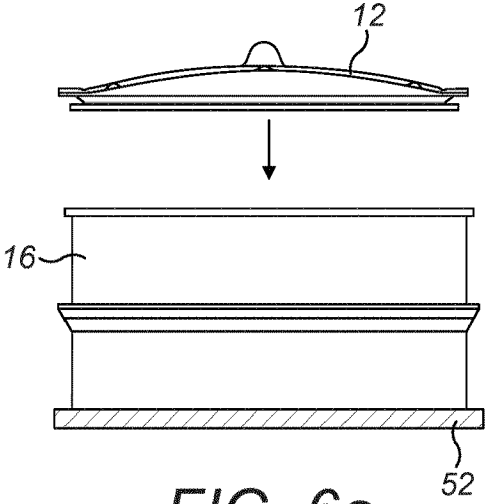
Figure 6C:
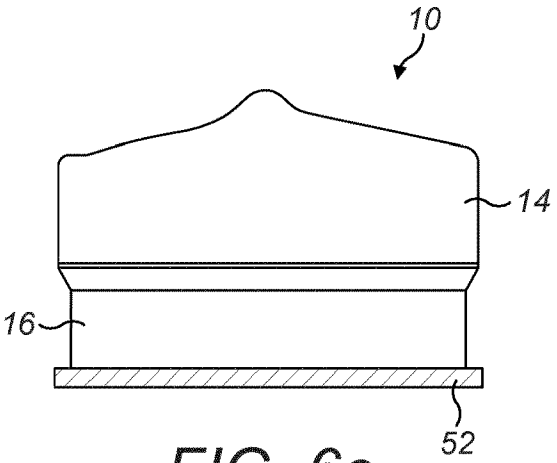
Figure 7A:
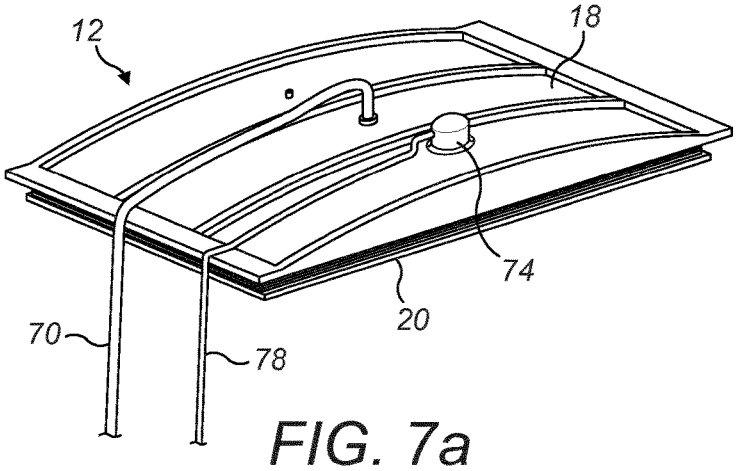
Figure 7B:
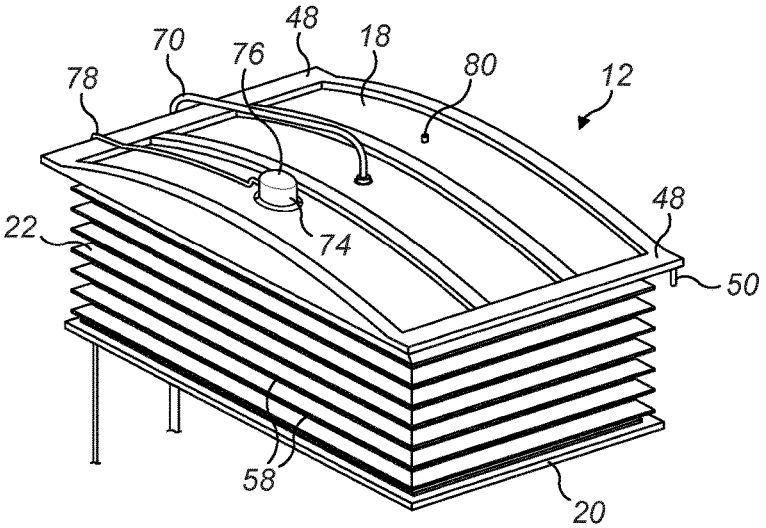
Figure 7C:
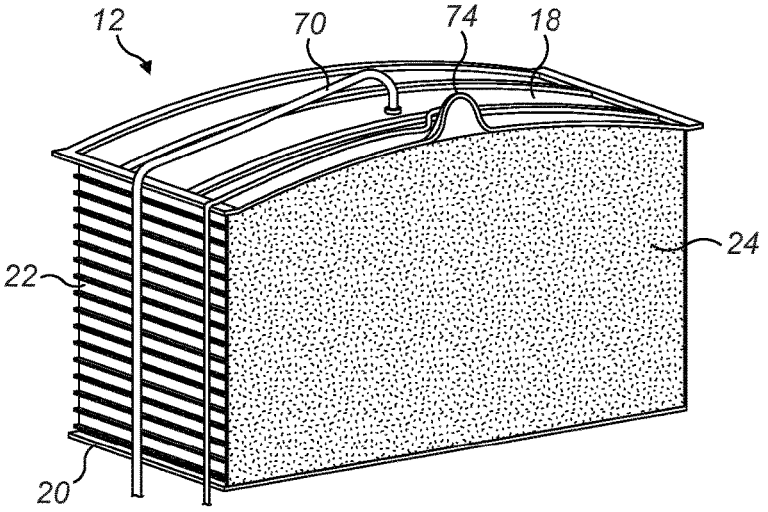
Figure 8A:
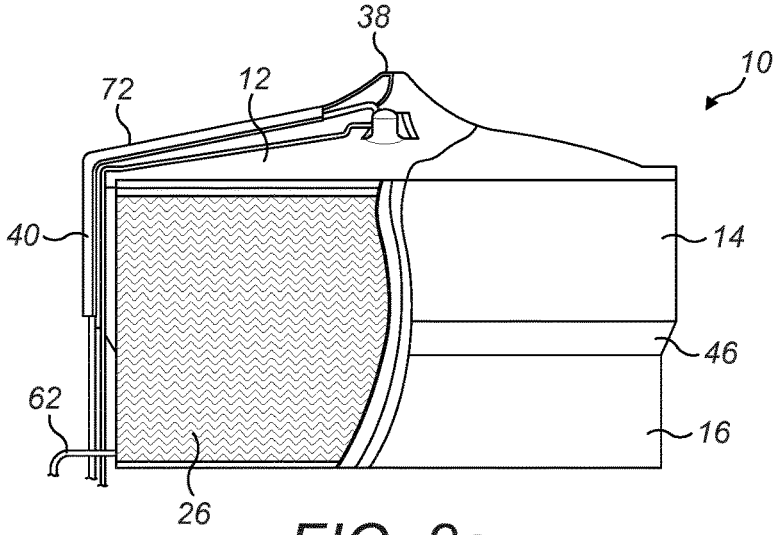
Figure 8B:
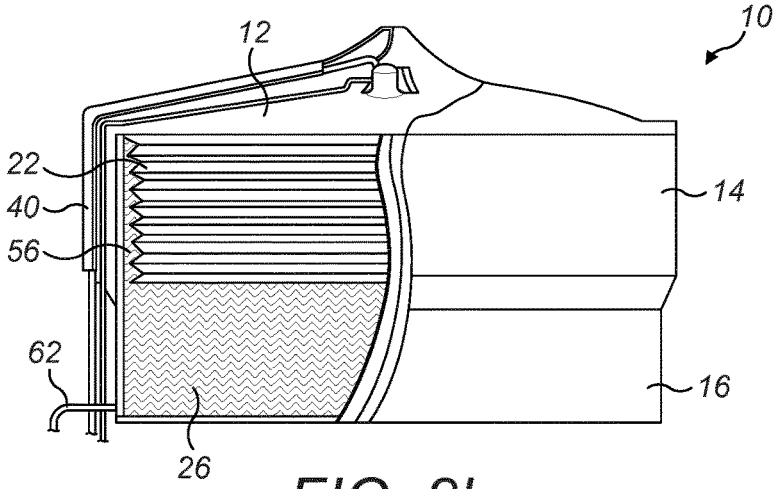
Figure 8C:
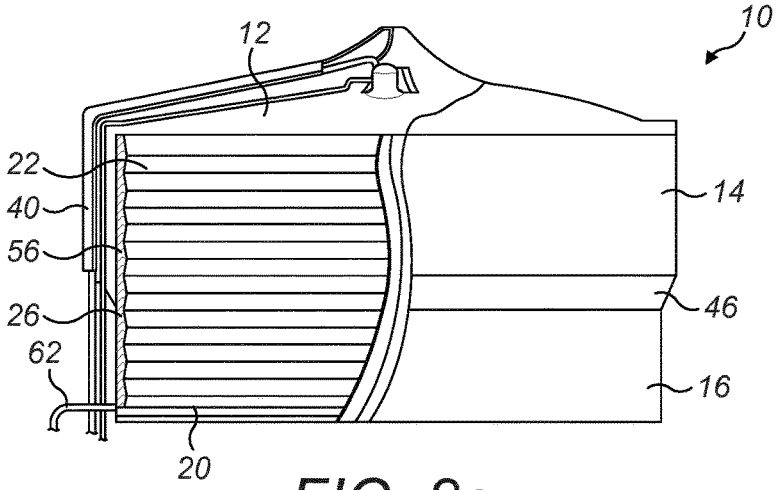
Figure 9:
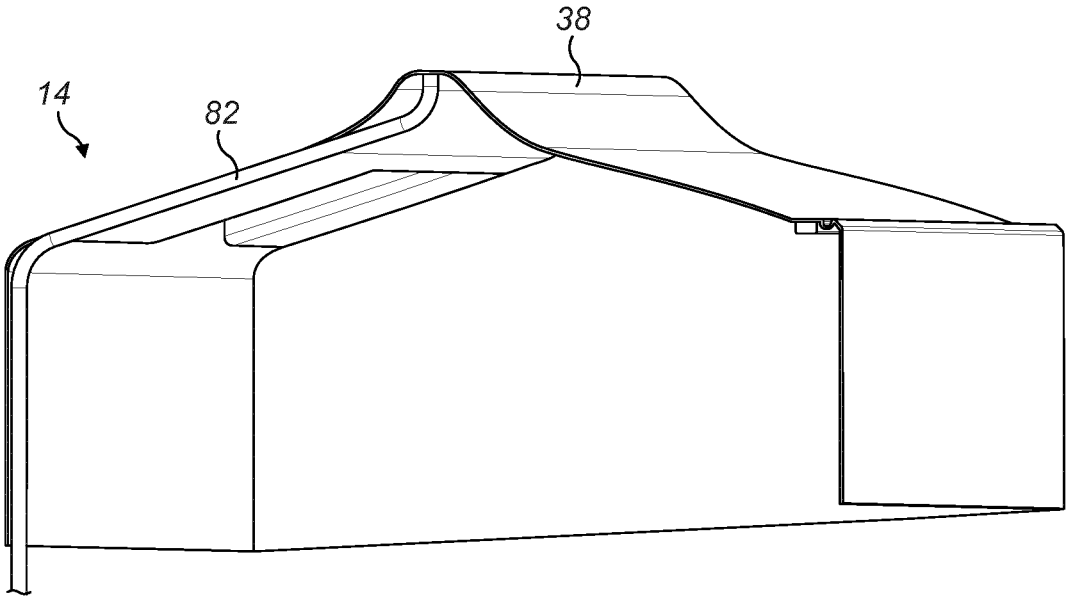
Figure 10:
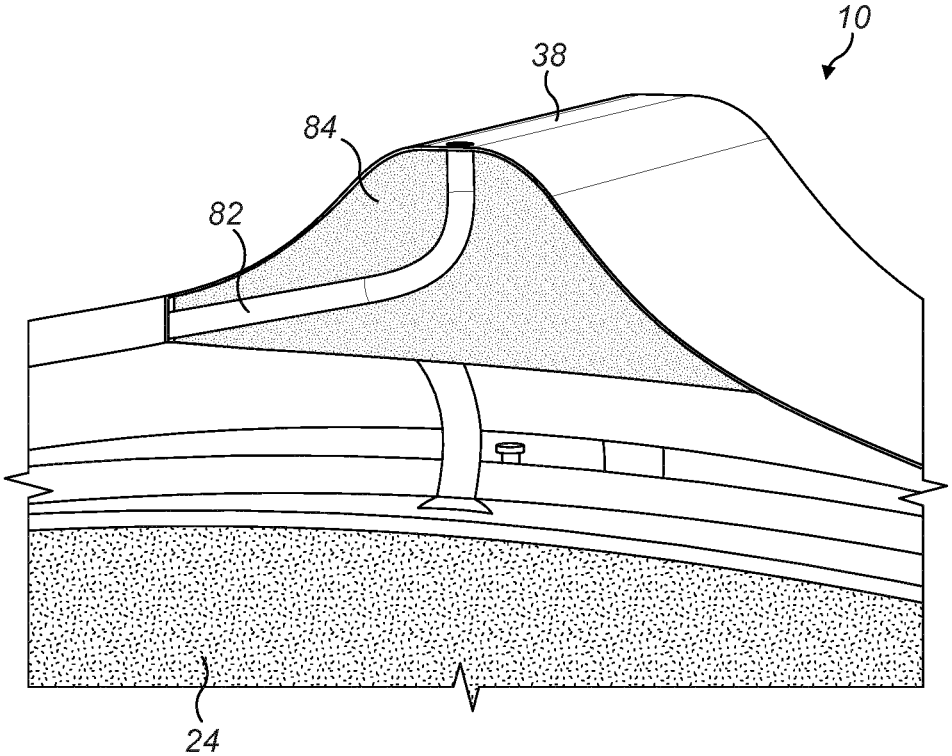
Figure 11:
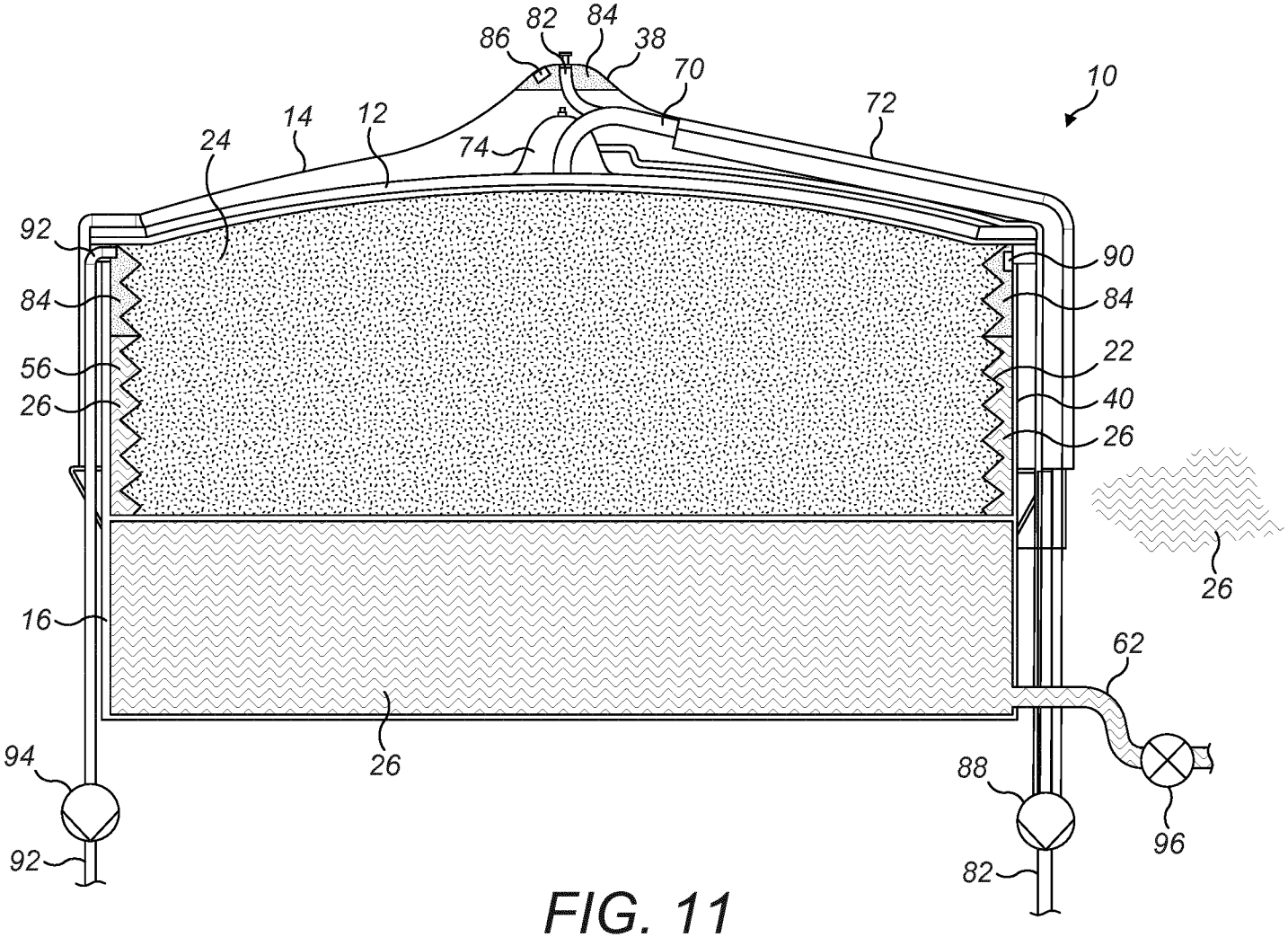
Figure 12:
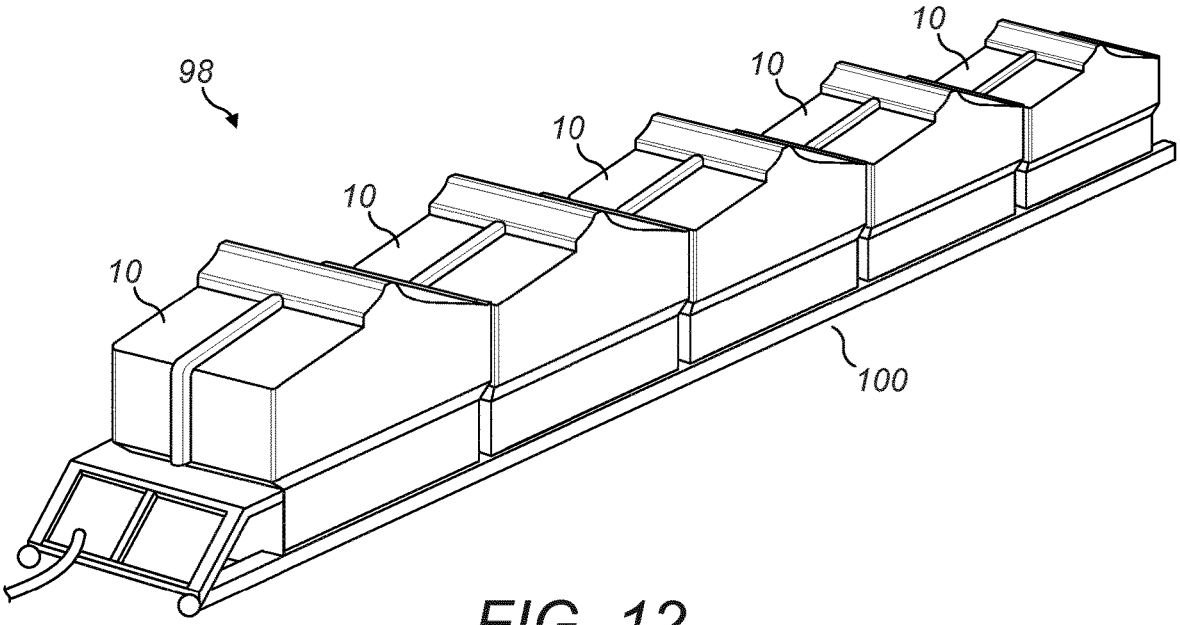
Figure 13:
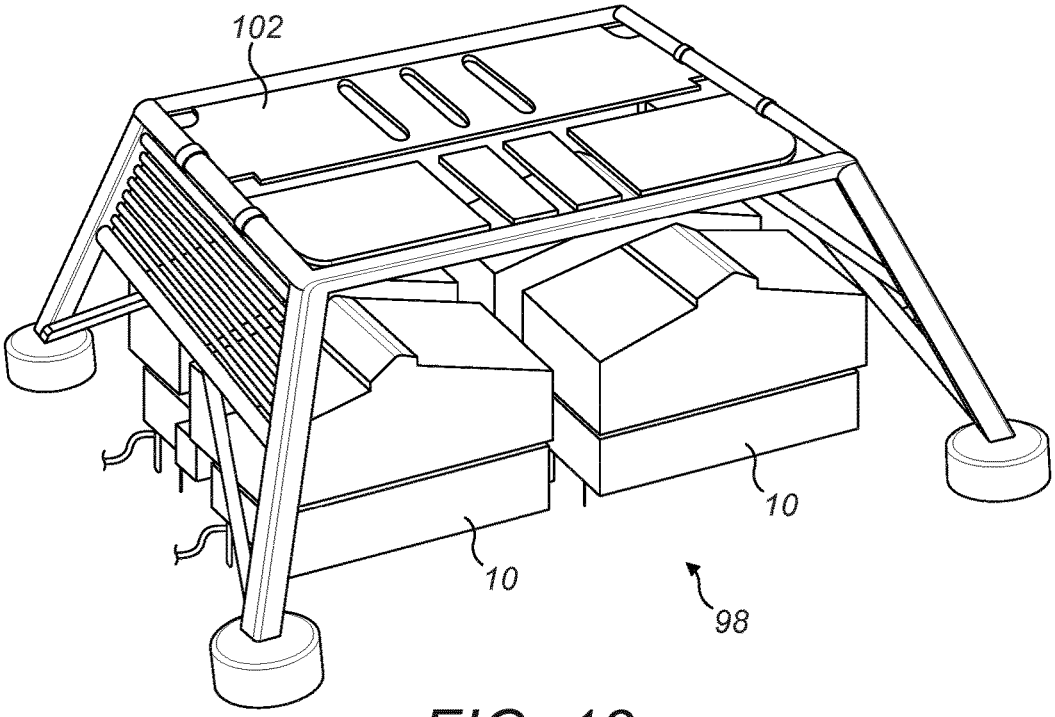
Figure 14:
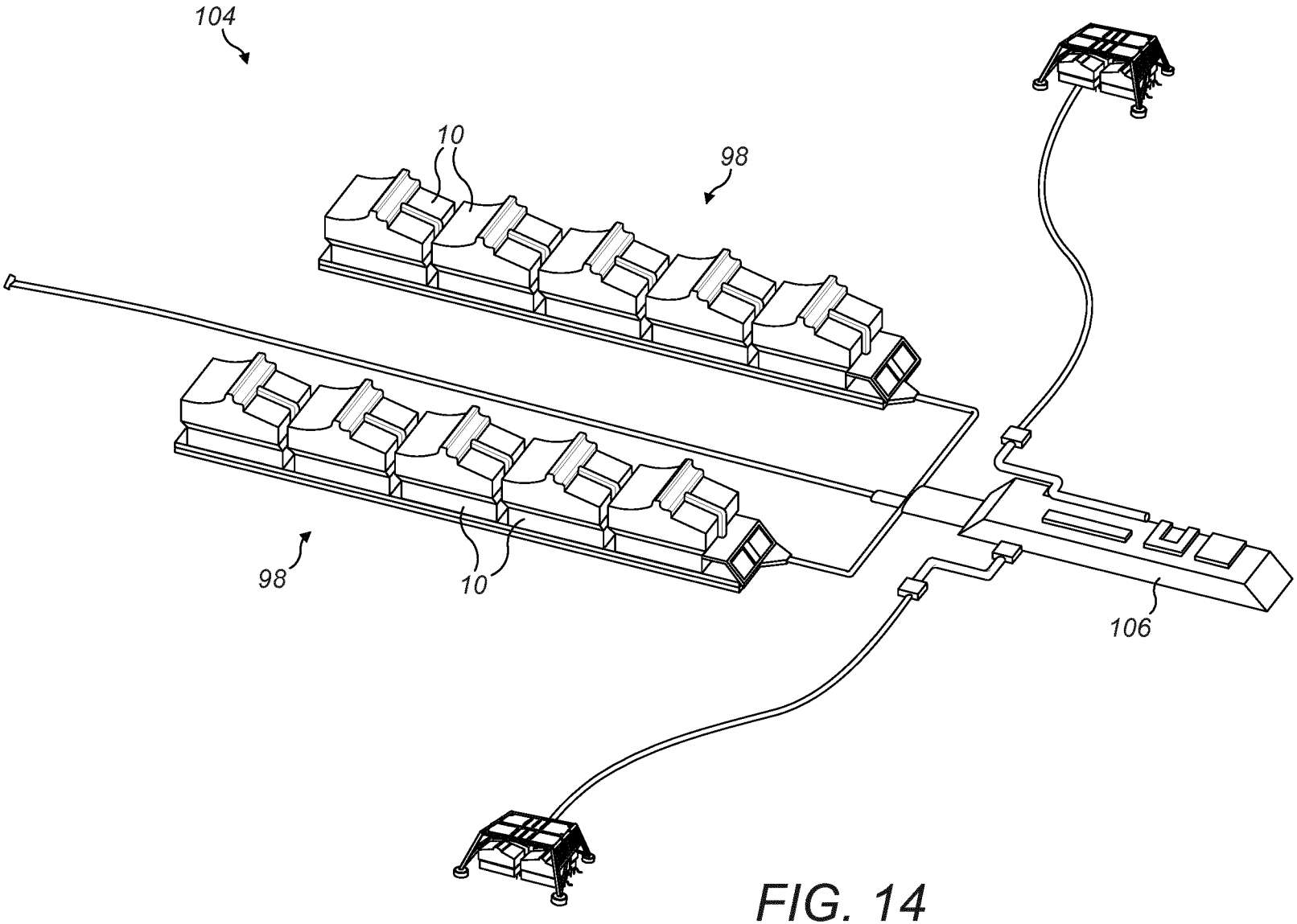

FIGS. 6*a*, 6*b* and 6*c* are a sequence of side view of the storage unit being assembled from modular components underwater;

FIGS. 7*a*, 7*b* and 7*c* are a sequence of perspective views of an inner tank of the storage unit expanding progressively by virtue of a collapsible peripheral wall as it is filled with oil;

FIGS. 8*a*, 8*b* and 8*c* are a sequence of cut-away side views corresponding to the sequence of views in FIGS. 7*a*, 7*b* and 7*c* but showing the whole storage unit;

FIG. 9 is a cut-away perspective view of an upper part of the storage unit;

FIG. 10 is an enlarged view showing how the upper part of the storage unit is shaped to trap leaked oil;

FIG. 11 is a sectional side view corresponding to FIG. 4 but showing further features of the storage unit for sensing and removing leaked oil;

FIG. 12 is a perspective view of a group of storage units of the invention being towed to an installation site;

FIG. 13 is a perspective view of a PLET that incorporates a group of storage units of the invention; and FIG. 14 is a perspective view of groups of subsea storage units of the invention connected to a subsea production system in a small pool layout.

FIGS. 1 to 4 of the drawings show a subsea storage unit 10 of the invention that comprises an expandable inner tank 12. The inner tank 12 is sandwiched between, and contained for expansion within, an upper part 14 and a lower part 16 that fit together telescopically to form a hollow rigid housing.

In this example, the storage unit 10 is generally rectangular in plan view. This is advantageous for space efficiency, as it allows the storage unit 10 to abut other flat-sided storage units 10 or other flat-sided structures that have straight sides in plan view. However, in principle, the storage unit 10 could have another shape in plan view, such as a circular shape.

The inner tank 12 comprises a collapsible enclosure that is defined between a top panel 18 and a bottom plate 20, connected by and sealed to a flexible peripheral wall 22. The peripheral wall 22 and the bottom plate 20 hang from the top panel 18. The peripheral wall 22 surrounds and encircles a storage volume of the inner tank 12 and is continuous in a horizontal plane.

In use, the inner tank 12 stores a fluid, such as crude oil 24, natural gas or oily produced water. Advantageously, the inner tank 12 prevents contact between the oil 24 stored in the inner tank 12 and the surrounding seawater 26. This minimises the risk of hydrate formation and avoids an emulsion forming or bacterial growth at an oil/water interface.

The top panel 18 and the bottom plate 20 are substantially rigid whereas the peripheral wall 22 between them is flexible so as to be extensible and retractable vertically. The peripheral wall 22 may, for example, be made of textile or polyester woven yarn coated with an impermeable layer of polymer on either or both sides. Extension and retraction of the peripheral wall 22 varies the volume of the enclosure in accordance with a variable volume of oil 24 that is held within the enclosure.

The upper part 14, lower part 16, top panel 18 and bottom plate 20 are all apt to be produced in respective moulds, for example by laying-up GRP. Such moulds can be re-used to manufacture multiple storage units 10 in series.

The upper part 14 of the storage unit 10 has a continuous open-bottomed skirt 28 that depends downwardly from, and is contiguous with, a gable roof 30. Oppositely-inclined sections 32, 34 of the roof 30 join the skirt 28 at respective shoulders 36 and meet centrally at a rounded ridge 38. Viewed externally, the sections 32, 34 of the roof 30 have concave curvature; consequently, the ridge 38 bulges upwardly in side view.

The upper part 14 is suitably designed to withstand over-trawling of the storage unit 10 and to resist damage to the storage unit 10 in the event that an object is dropped onto the storage unit 10, for example from a vessel on the surface above.

The lower part 16 of the storage unit 10 has a continuous open-topped side wall 40 that extends upwardly from, and is contiguous with, a flat base 42. The side wall 40 is surmounted by an outwardly-extending support flange 44 and is surrounded by a ledge 46 at an intermediate level between the base 42 and the support flange 44.

The upper part 14 and the lower part 16 of the storage unit 10 correspond in plan shape, as defined respectively by the skirt 28 and the side wall 40. However, the upper part 14 has greater length and width so as to overlap the lower part 16 in plan view. The overlap is such that the upper portion of the side wall 40 above the ledge 46 is surrounded by, and received telescopically in, the skirt 28. The bottom edge of the skirt 28 rests on the ledge 46 that protrudes from the side wall 40. As best appreciated in FIGS. 3 and 4, the ledge 46 has a downwardly-tapering underside that avoids the bottom edge of the skirt 28 being snagged in the event of over-trawling.

The top panel 18 of the inner tank 12 closes the open top of the lower part 16 defined by the side wall 40. For this purpose, the top panel 18 extends laterally beyond the peripheral wall 22 of the inner tank 12 to form a hanging flange 48. When the inner tank 12 is placed onto the lower part 16, the hanging flange 48 sits on top of the support flange 44 that surmounts the side wall 40 of the lower part 16.

The interface between the hanging flange 48 and the support flange 44 need not be a fully-sealed connection. However, a gasket could be interposed between the hanging flange 48 and the support flange 44 to improve sealing.

One or more ROV-accessible clamps or locking pins 50 fix the hanging flange 48 of the inner tank 12 to the support flange 44 of the lower part 16. This connection acts in tension to transfer uplift forces from the inner tank 12, due to buoyancy of the oil 24 within, to the lower part 16 and from there to a subsea foundation 52 on the seabed 54. The lower part 16 is therefore attached to the foundation 52 in a manner that resists buoyant upthrust, for example with bolts that extend from the lower part 16 into the foundation 52.

When the upper part 14 of the storage unit 10 is placed on top of the assembly of the inner tank 12 and the lower part 16, the hanging flange 48 of the inner tank 12 is sandwiched between the support flange 44 of the lower part 16 and the shoulders 36 of the upper part 14. The upper part 14 may have negative buoyancy to apply stabilising weight forces to the inner tank 12 and the lower part 16. The upper part 14 may additionally be fastened to the inner tank 12 and/or to the lower part 16, for example by bolts or clamps.

The peripheral wall 22 of the inner tank 12 hangs within the side wall 40 of the lower part 16, with lateral clearance being maintained by a gap 56 between the peripheral wall 22 and the side wall 40. There should be no contact and hence no friction between the peripheral wall 22 and the side wall 40. The gap 56 entirely surrounds the peripheral wall 22 in a horizontal plane and so is annular, continuous or encircling.

The peripheral wall 22 of the inner tank 12 is shaped with folded, collapsible bellows-like concertina formations 58 that are flexible or hinged so that the peripheral wall 22 can extend downwardly into the lower part 16 like a concertina as the inner tank 12 fills with oil 24 as shown in FIG. 4. The length and width of the peripheral wall 22 remain substantially constant during this downward extension, apart from minor localised straightening of the concertina formations 58. Thus, the gap 56 between the peripheral wall 22 and the side wall 40 of the lower part 16 remains substantially constant as the bottom plate 20 of the inner tank 12 moves up and down within the lower part 16.

The substantially flat and horizontal bottom plate 20 of the inner tank 12 hangs from, and closes the bottom of, the peripheral wall 22. The bottom plate 20 matches the shape of the side wall 40 of the lower part 16 in plan view and extends laterally beyond the peripheral wall 22 of the inner tank 12. This holds the peripheral wall 22 away from the side wall 40 to preserve the gap 56, regardless of hinging movement of the concertina formations 58.

Figure 5:
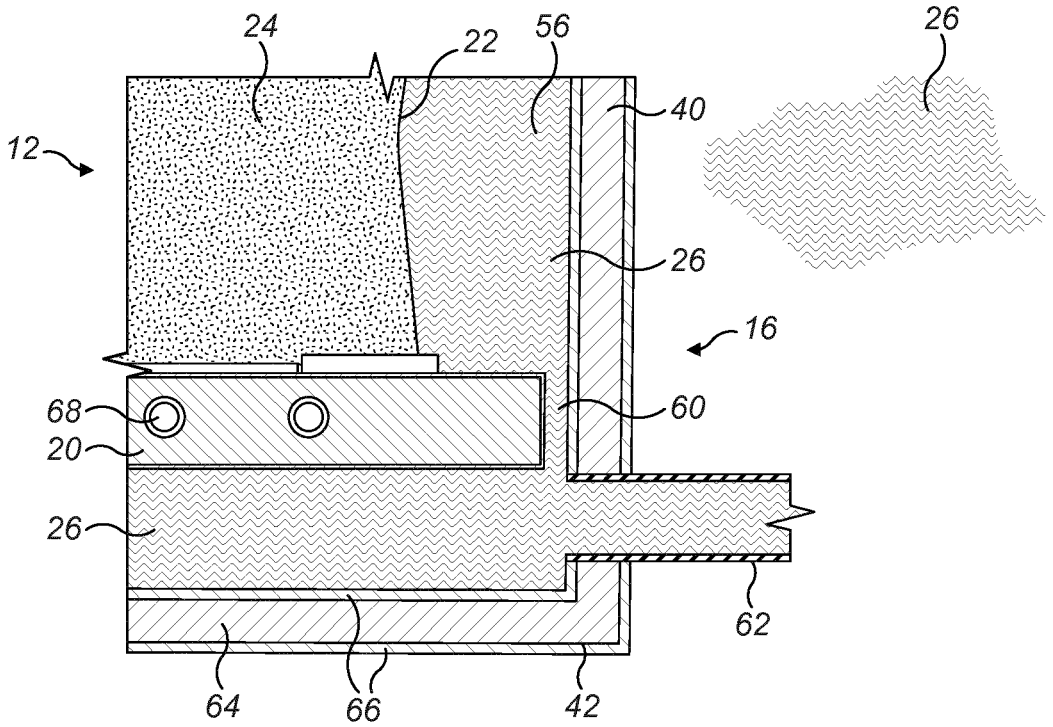
FIG. 5 is an enlarged detail view of the storage unit shown in FIG. 4, when substantially full of oil.

As best seen in the enlarged view of FIG. 5, a small lateral clearance 60 is left between the outer edge of the bottom plate 20 and the side wall 40. Like the gap 56, the clearance 60 is continuous in a horizontal plane and extends around the full periphery of the bottom plate 20. The clearance 60 is substantially narrower than the gap 56 between the peripheral wall 22 and the side wall 40, above the level of the bottom plate 20. There may be some sliding contact between one or two sides of the bottom plate 20 and the side wall 40 as the bottom plate 20 moves up and down within the lower part 16.

Alternatively or in combination, the projecting rectangular ring of the bottom plate 20 spanning between the peripheral wall 22 and the side wall 40 can comprise holes, bores or passages for seawater 26 to pass through the bottom plate 20.

Seawater 26 in the gap 56 between the peripheral wall 22 and the side wall 40, trapped under the hanging flange 48, will be heated by thermal conduction through the peripheral wall 22 from hot oil 24 stored within the inner tank 12. In view of the lower density of the warmer seawater 26 and the narrow clearance 60 between the bottom plate 20 and the side wall 40, there is very little exchange between the heated seawater 26 in the gap 56 and the slightly cooler seawater 26 in the lower part 16 under the bottom plate 20.

The ambient temperature of the seawater 26 surrounding the storage unit 10 will typically be 4° C. in deep water. If the oil 24 in the inner tank 12 is at a temperature of then, as a non-limiting illustration, the seawater 26 in the lower part 16 under the bottom plate 20 may settle at a temperature of about 35° C. and the seawater 26 in the gap 56 between the peripheral wall 22 and the side wall 40 may settle at a temperature of about 55° C. The warmth and thickness of the bodies of seawater 26 at those locations, and especially in the gap 56 surrounding the uninsulated peripheral wall 22, thermally insulates the inner tank 12 and so helps to retain heat in the oil 24 stored within.

Thermal insulation of the inner tank 12 is further assured by seawater 26 that floods the space between the side wall 40 and the surrounding skirt 28 of the upper part 14. That space accommodates the laterally-projecting support flange 44 and is closed by the ledge 46.

Figure 1:
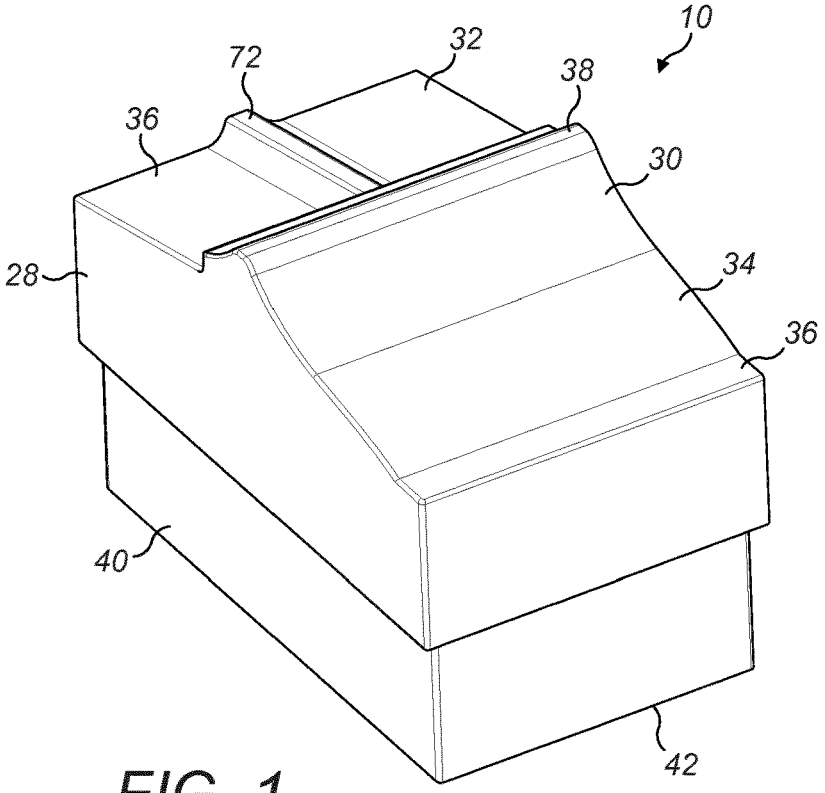
FIG. 1 is a perspective view of a subsea storage unit of the invention, when assembled.
Figure 2:
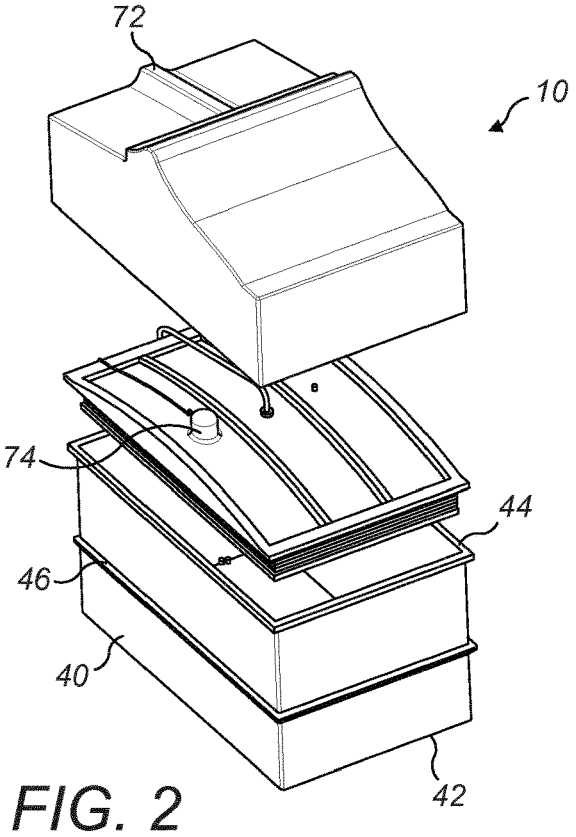
FIG. 2 is an exploded perspective view of the storage unit shown in FIG. 1, showing the main elements of the unit as a general arrangement.
Figure 3:
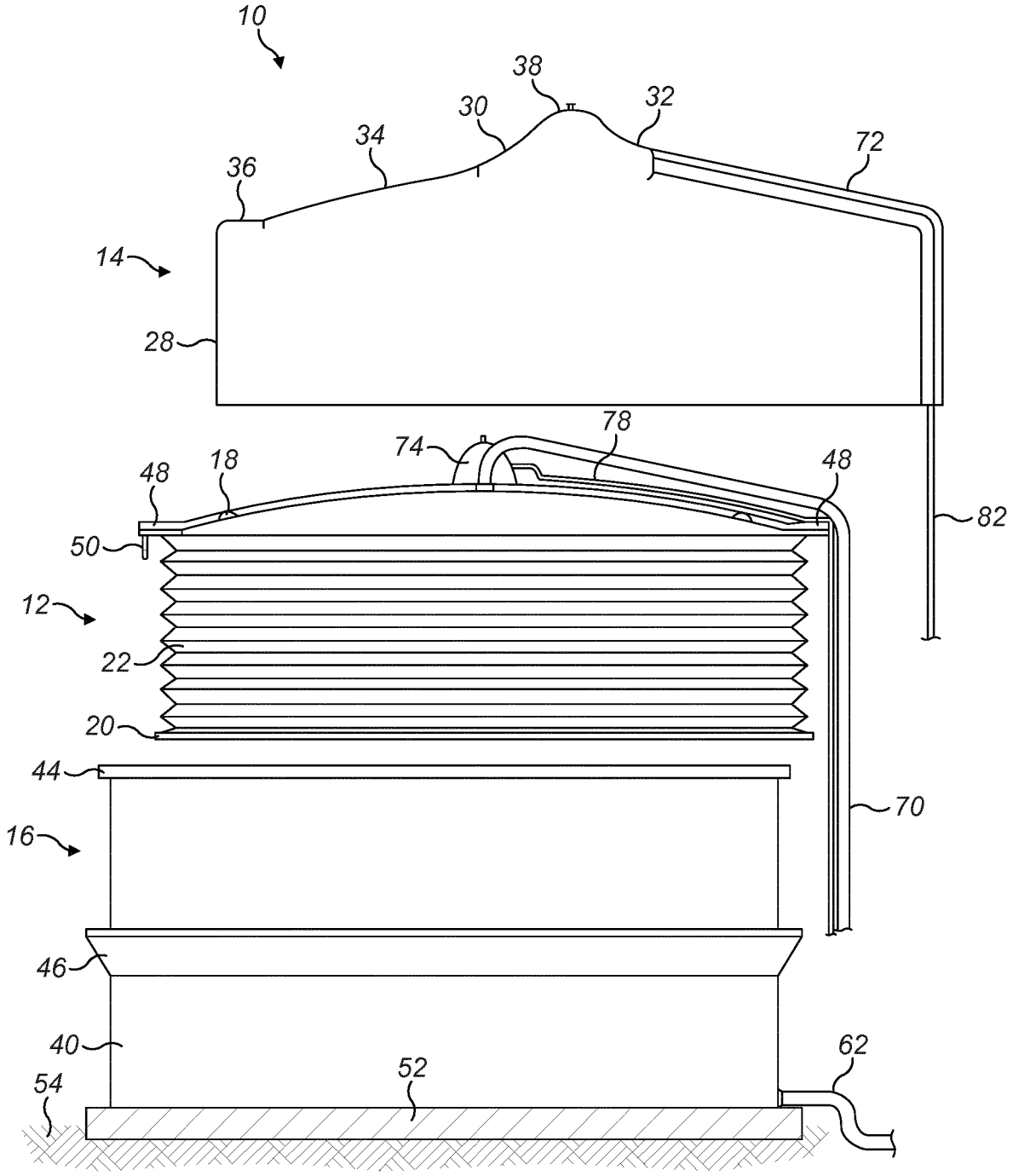
FIG. 3 is an exploded side view of the storage unit shown in FIGS. 1 and 2.

In addition to anchoring the storage unit 10 to the seabed 54 via the foundation 52, the lower part 16 controls the ingress and egress of seawater 26 into the storage unit 10 as ballast and as further thermal insulation. For this purpose, a seawater ballast pipe 62 near the seabed 54 as shown in FIGS. 3 to 5 allows untreated seawater 26 to flow into or out of the lower part 16 of the storage unit 10, in accordance with the degree of extension and hence displacement of the inner tank 12. The seawater ballast pipe 62 suitably has a filter or grid to filter out possible obstructions.

FIG. 5 shows that the side wall 40 and base 42 of the lower part 16 are advantageously of sandwich construction comprising a thermally-insulating core 64 between skins 66 of GRP or other substantially impermeable materials. The core 64 is suitably of a foam such as syntactic foam to resist hydrostatic pressure. The bottom plate 20 of the inner tank 12 is of similar sandwich construction, as is the top panel 18 of the inner tank 12.

FIG. 5 also shows that, optionally, the bottom plate 20 of the inner tank 12 has heating elements 68 to maintain the temperature of the oil stored in the inner tank 12. Where the heating elements 68 are electrically powered, a cable (not shown) suitably hangs from the top panel 18 of the inner tank 12 to provide power to the heating elements 68. The heating elements 68 could take another form, such as a heating mat.

Moving on now to FIGS. 6*a*, 6*b* and 6*c*, it will be apparent that the storage unit 10 can be assembled underwater by lowering its main components to the subsea foundation 52 separately and in succession. These relatively light loads reduce reliance on expensive heavy-lift vessels and favourable sea states. Specifically, the lower part 16 is first fixed to the subsea foundation 52 as shown in FIG. 6*a*, which also shows the inner tank 12 in a fully-collapsed state while being lowered through the water column toward the lower part 16. Next, the inner tank 12 is fixed to the lower part 16 as shown in FIG. 6*b*, which also shows the upper part 14 being lowered through the water column toward the assembly of inner tank 12 and the lower part 16. Finally, the upper part 14 is fixed to the assembly of the inner tank 12 and the lower part 16. The storage unit 10 can be disassembled in reverse order.

It will also be apparent that, if needs be, the inner tank 12 can be removed and replaced underwater by lifting the upper part 14 away from the lower part 16 temporarily, without removing the lower part 16 from the foundation 52. The upper part 14 could be raised to the surface or left temporarily on the seabed 54 beside the lower part 16 while the inner tank 12 is being removed and replaced.

FIGS. 7*a*, 7*b* and 7*c* show the inner tank 12 in isolation. The inner tank 12 is shown here expanding progressively, as it would when being filled with oil 24, which causes the bottom plate 20 to move away from the top panel 18 as the peripheral wall 22 extends downwardly. The inner tank 12 thereby expands from a fully-collapsed state shown in FIG. 7*a* through a partially-filled intermediate state shown in FIG. 7*b* to a fully-filled, fully-extended state shown in FIG. 7*c*. Advantageously, when in the fully-collapsed state shown in FIG. 7*a* and also in FIG. 6*a*, the inner tank 12 can more easily handle changes of hydrostatic pressure when being lowered through the water column for installation subsea.

Correspondingly, FIG. 8*a* shows the lower part 16 of the storage unit 10 full of seawater 26 in the space vacated by the fully-collapsed inner tank 12 as shown in FIG. 7*a*. FIG. 8*b* shows the inner tank 12 in the partially-filled intermediate state shown in FIG. 7*b*, having displaced about half of the seawater 26 from the lower part 16 through the seawater ballast pipe 62. FIG. 8*c* shows the inner tank 12 in the fully-extended state shown in FIG. 7*c*, having displaced most of the remaining seawater 26 from the lower part 16 through the seawater ballast pipe 62. In both FIGS. 8*b* and 8*c*, it will be apparent that an insulating shroud of warm seawater 26 remains in the gap 56 between the peripheral wall 22 of the inner tank 12 and the side wall 40 of the lower part 16.

When the storage unit 10 starts to be filled with oil 24, wax could form in the oil 24 due to the temperature gradient between the seawater 26 and the oil 24. However as the volume of oil 24 increases with continued filling, the wax will melt due to the heat of the enlarged body of oil 24 increasing the temperature of the wax.

The top panel 18 of the inner tank 12 has a shallowly-arched shape in side view, hence having convex curvature when viewed from above. Oil 24 flows into and out of the inner tank 12 through an inlet/outlet pipe 70 that enters the top panel 18 at its highest point defined by its central apex. The inlet/outlet pipe 70 extends externally along the top panel 18 and then down one side of the inner tank 12. An integral channel 72 in one of the inclined sections 32 of the roof 30, best seen in FIGS. 1 and 2, accommodates and protects the inlet/outlet pipe 70 when the upper part 14 is lowered onto the inner tank 12.

The arched shape adds stiffness to the top panel 18. The arched shape also gathers any gas that separates and rises from the oil in the inner tank 12 and directs that gas toward and into a gas collection chamber defined under an upwardly-protruding bell-shaped central blister 74. The blister 74 supports a sensor and transmitter 76 that monitors the pressure or level of gas in the chamber under the blister 74 so that the gas can be drawn off when necessary.

Gas is drawn off from the gas collection chamber under the blister 74 via a gas outlet pipe 78 that, like the inlet/outlet pipe 70, extends externally along the top panel 18 and then down one side of the inner tank 12. As will be apparent from FIG. 4 of the drawings, the blister 74 is at the central apex of the top panel 18 in alignment with, and accommodated under, the ridge 38 at the top of the upper part 14.

The top panel 18 also carries one or more sensors 80 for parameters such as the volume or temperature of oil 24 in the inner tank 12. For example, the sensor 80 may comprise an acoustic transducer for measuring the depth of the oil 24 in the inner tank 12.

The upper part 14 defines a continuous secondary shell or barrier to catch any oil 24 that may leak from the inner tank 12. Beneficially, no pipe connections or other penetrations need to penetrate the shell that constitutes the upper part 14. In this respect, reference is made to FIGS. 8 and 9.

FIG. 9 shows the underside of the ridge 38 at the top of the upper part 14. The integral channel 72 in one of the inclined sections 32 of the roof 30 accommodates a drainage pipe 82 that terminates at its upper end within the protrusion of the ridge 38.

FIG. 10 shows that the ridge 38 defines a fluid trap chamber that gathers and traps any droplets of oil 24 that may rise from the inner tank 12 beneath the upper part 14 of the storage unit 10. The resulting oily water 84 may then be drained away through the drainage pipe 82. In this respect, FIG. 11 shows an oil leak detector 86 positioned in the space under the ridge 38. A pump 88 is responsive to a signal from the oil leak detector 86 to draw the oily water 84 into the drainage pipe 80.

FIG. 11 shows further features of the storage unit 10 for sensing and removing leaked oil. Specifically, another oil leak detector 90 is positioned at the top of the gap 56 between the peripheral wall 22 of the inner tank 12 and the side wall 40 of the lower part 16. A drainage line 92 communicates with the top of the gap 56. If the oil leak detector 90 detects oily water 84 in the gap 56, a pump 94 is activated to draw the oily water 84 into the drainage line 92.

If either of the oil leak detectors 86, 90 detect a substantial leak of oil 24, an emergency procedure may be activated. The emergency procedure involves closing the inlet/outlet pipe 70 to prevent further intake of oil 24 and closing a valve 96 in the seawater ballast pipe 62. The leak is then stopped and under control. A shuttle tanker can then visit the storage unit 10 to empty the inner tank 12 by offloading the oil 24 as normal.

Oily water trapped in the space under the ridge 38 or in the gap 56 is pumped through the drainage pipe 80 or the drainage line 92, as appropriate, and into a slop tank onboard the shuttle tanker, or into another treatment or storage facility such as a neighbouring storage unit 10. The defective storage unit 10 is then ready to be dismantled and inspected before being refitted with a new inner tank 12.

It will be apparent that the storage unit 10 of the invention provides at least two barriers to leakage of a stored fluid such as crude oil. The first barrier is between the peripheral wall 22 of the inner tank 12 and the surrounding lower part 16. The second barrier is between the upper part 14 and the surrounding seawater 26. The upper part 14 that defines this second barrier has an inner volume that will capture leaking fluid. A third barrier may be defined if a sealed connection is made between the lower part 16 and the top panel 18 of the inner tank 12.

Turning finally to FIGS. 12 to 14, these drawings show various ways in which storage units 10 of the invention may be used. In each case, multiple storage units 10 are interconnected in a group 98 that provides redundancy and extra storage volume. It is possible for the storage units 10 of a group 98 to contain different fluids, such as crude oil in one storage unit 10 and natural gas in another storage unit 10.

FIG. 12 shows a group 98 of storage units 10 that are disposed end-to-end in a row as an elongate linear array. The group 98 is supported on a towable installation frame 100 that can be sunk to the seabed while carrying the entire group 98. This exemplifies how storage units 10 need not necessarily be installed individually or in multiple lifts of modular components.

FIG. 13 shows a group 98 of storage units 10 in a square array integrated with a pipeline end termination (PLET) 102.

FIG. 14 shows a subsea installation 104 that comprises two groups 98 of storage units 10. The groups 98 are each connected to a subsea processing or production system 106 to receive treated crude oil or natural gas. In this example, each group 98 is an elongate linear array, like that shown in FIG. 12, and is apt to have been transported to the installation site by towing.

Many variations are possible within the inventive concept. For example, the skirt 28 of the upper part 14 could extend further down the side wall 40 of the lower part 16. Potentially, the skirt 28 could extend in parallel to the side wall 40 for substantially the full height of the side wall 40. The ledge 46 could therefore be positioned differently on the side wall 40 or omitted, in which case the weight of the upper part 14 could be supported at the top of the side wall 40.

The invention claimed is:

1. A subsea fluid storage unit, comprising:

a variable-volume inner tank having a rigid top panel and a peripheral wall that is extensible and retractable in a vertical direction;

a side wall that surrounds and is spaced from the peripheral wall of the inner tank in a horizontal direction to define a floodable gap that surrounds the tank between the peripheral wall and the side wall;

an upper housing part that extends over and is spaced from the rigid top panel of the inner tank in the vertical direction and cooperates with the side wall to enclose the inner tank; and a seawater inlet/outlet communicating with the floodable gap;

wherein the upper housing part overlaps the side wall in the horizontal direction and wherein a skirt of the upper housing part extends substantially parallel to the side wall on an external side of the side wall such that the side wall is received telescopically within the skirt, and wherein the rigid top panel is sandwiched between the upper housing part and the side wall.

2. The unit of claim 1, wherein the upper housing part overlaps the inner tank in the horizontal direction.

3. The unit of claim 1, wherein the upper housing part is substantially continuous across a full width of the inner tank in the horizontal direction.

4. The unit of claim 1, wherein the skirt adjoins a ledge that projects outwardly from the side wall.

5. The unit of claim 1, wherein the upper housing part rises inwardly from the side wall to an elevated fluid trap chamber for trapping fluid leaked from the inner tank.

6. The unit of claim 5, further comprising a leakage sensor arranged to sense leaked fluid in the fluid trap chamber and a drainage pipe that communicates with the fluid trap chamber to drain the leaked fluid.

7. The unit of claim 1, wherein the inner tank is closed by a bottom plate that extends in the horizontal direction along a bottom edge of the peripheral wall.

8. The unit of claim 7, wherein the bottom plate projects beyond the peripheral wall in the horizontal direction.

9. The unit of claim 8, wherein the clearance between the bottom plate and the side wall is a sliding clearance.

10. The unit of claim 7, wherein the bottom plate supports a heating system for heating fluid contents of the tank in use.

11. The unit of claim 1, wherein the side wall is thermally insulated.

12. The unit of claim 1, wherein the side wall has lower thermal transmittance than the peripheral wall of the inner tank.

13. The unit of claim 1, wherein the peripheral wall is flexible.

14. The unit of claim 13, wherein the peripheral wall has greater stiffness in the horizontal direction than in the vertical direction.

15. The unit of claim 13, wherein the peripheral wall comprises folded or hinged formations that are expandable in the manner of a concertina.

16. The unit of claim 1, wherein the side wall is contiguous with a base to define a floodable enclosure extending beneath the inner tank.

17. The unit of claim 16, wherein the floodable enclosure communicates with the floodable gap.

18. The unit of claim 16, wherein the base is thermally insulated.

19. The unit of claim 16, further comprising a seawater inlet/outlet communicating with the enclosure.

20. The unit of claim 16, wherein the inner tank closes an open top of the enclosure.

21. The unit of claim 20, wherein the rigid top panel of the inner tank is supported by the side wall.

22. The unit of claim 21, wherein the side wall supports a hanging flange of the top panel that projects beyond the peripheral wall in the horizontal direction.

23. The unit of claim 1, further comprising a leakage sensor arranged to sense fluid in the floodable gap leaked from the inner tank and a drainage line that communicates with the floodable gap to drain the leaked fluid.

24. The unit of claim 1, wherein the rigid top panel of the inner tank rises inwardly from the side wall to an elevated gas trap chamber for trapping gas rising from a fluid in the inner tank.

25. The unit of claim 1, comprising subsea-releasable fastenings acting in tension between the inner tank and the side wall.

26. The unit of claim 1, wherein the side wall has at least a portion that is substantially flat.

27. A group of units of claim 1, coupled together for fluid communication between the inner tanks of the group.

28. The group of claim 27, wherein the units are arranged in an elongate towable array.

* * * * *